US010145634B2

(12) United States Patent
Zukowski

(10) Patent No.: US 10,145,634 B2
(45) Date of Patent: Dec. 4, 2018

(54) PISTOL AND CAPTIVE RECOIL SPRING

(71) Applicant: Smith & Wesson Corp., Springfield, MA (US)

(72) Inventor: Gary Zukowski, Ludlow, MA (US)

(73) Assignee: Smith & Wesson Corp., Springfield, MA (US)

( * ) Notice: Subject to any disclaimer, the term of this patent is extended or adjusted under 35 U.S.C. 154(b) by 212 days.

(21) Appl. No.: 15/266,641

(22) Filed: Sep. 15, 2016

(65) Prior Publication Data

US 2018/0073825 A1 Mar. 15, 2018

(51) Int. Cl.
*F41A 3/00* (2006.01)
*F41A 3/86* (2006.01)
*F41C 3/00* (2006.01)

(52) U.S. Cl.
CPC . *F41A 3/86* (2013.01); *F41C 3/00* (2013.01)

(58) Field of Classification Search
CPC ..... F41A 3/82; F41A 3/86
USPC ..... 89/198, 199
See application file for complete search history.

(56) References Cited

U.S. PATENT DOCUMENTS

| | | | | |
|---|---|---|---|---|
| 3,112,103 | A | 11/1963 | Falkenberg | |
| 6,129,000 | A * | 10/2000 | Schmid | F41A 3/16 89/187.01 |
| 8,297,176 | B2 * | 10/2012 | Buschow | F41A 3/86 89/196 |
| 8,701,326 | B2 | 4/2014 | Zonshine | |
| 8,931,394 | B2 | 1/2015 | Bryant et al. | |

* cited by examiner

*Primary Examiner* — J. Woodrow Eldred
(74) *Attorney, Agent, or Firm* — Ballard Spahr LLP; John A. Chionchio, Esq.

(57) ABSTRACT

A captive recoil spring assembly includes a guide rod surrounded by a coil spring. The spring is captured between a base at one end of the guide rod, and a body at its opposite end. The body is shaped to engage the spring at one or more sectors, leaving one or more remaining sectors free to engage the slide. Use of such a body permits a round wire spring to be used without the need for close dimensional tolerances on the engaging parts.

36 Claims, 3 Drawing Sheets

PISTOL AND CAPTIVE RECOIL SPRING

FIELD OF THE INVENTION

This invention concerns captive recoil springs for semi-automatic pistols.

BACKGROUND

Captive recoil springs, when used with semiautomatic pistols, are known to provide a significant advantage during assembly and disassembly of the pistol. Captive recoil springs according to the prior art are usually coil springs which surround a guide rod and are "captured" using a round end cap attached to the free end of the guide rod (i.e., the end which does not engage the frame or the barrel). The end cap must be dimensioned so that it is smaller than the outer diameter of the coil spring. This leaves an outer portion of the end of the coil spring exposed to permit engagement with the slide.

When coil springs are made from wire having a round cross section there is a very small difference between their inner and outer diameters, the difference being merely twice the diameter of the wire comprising the spring. Because this difference is small, the end cap which captures the spring and the diameter of the opening in the slide where the slide engages the end of the recoil spring must be made to tight tolerances commensurate with the small diameter of the wire and the diameter of the spring coils. There is clearly an opportunity to gain advantage by using a round wire coil spring with components which do not need to be made to the exacting tolerances associated with prior art captive recoil springs.

SUMMARY

The invention concerns a recoil spring assembly for a firearm. The firearm has a slide movably mounted on a frame. In one example embodiment the assembly comprises a guide rod having a first end engageable with the frame and a second end oppositely disposed from the first end. A coil spring surrounds the guide rod and extends lengthwise therealong. The coil spring has first and second ends oppositely disposed. A base is mounted proximate the first end of the guide rod. The base has a base surface extending transversely to the guide rod and engaging the first end of the coil spring. A body is mounted proximate the second end of the guide rod. The body has a body surface extending transversely to the guide rod and engaging at least a first sector of the second end of the coil spring. A remaining sector of the second end of the coil spring is engageable with the slide.

In one example, the coil spring comprises a wire having a round cross section; in another example embodiment, the coil spring comprises a wire having a non-round cross section.

By way of further example, the body engages the second end of the coil spring at a second sector. In a particular example, the second sector is diametrically opposite to the first sector. In an example embodiment the body has a major dimension and a minor dimension measured transversely to the major dimension. The major dimension is larger than the minor dimension. The body engages the first and second sectors at opposite ends along the major dimension. In a particular example embodiment the body has a lozenge shape; in another example the body has a bar shape. Further by way of example the base comprises an annular cap. The base surface comprises a flange extending from the annular cap. The first end of the guide rod comprises a barb. The barb is received within the annular cap in this example embodiment.

The invention further encompasses a recoil spring assembly comprising a guide rod having a first end engageable with the frame and a second end oppositely disposed from the first end. A coil spring surrounds the guide rod and extends lengthwise therealong. The coil spring has first and second ends oppositely disposed. A base is mounted proximate the first end of the guide rod. The base has a base surface extending transversely to the guide rod and engaging the first end of the coil spring. A body is mounted proximate the second end of the guide rod. The body has a body surface extending transversely to the guide rod and engaging a first and a second sector of the second end of the coil spring. The first sector is diametrically opposite to the second sector in this example. A third and a fourth sector of the second end of the coil spring are engageable with the slide. The third and fourth sectors are positioned between the first and second sectors.

In one example the coil spring comprises a wire having a round cross section. In another example the coil spring has a non-round cross section. In a specific example embodiment the body has a major dimension and a minor dimension measured transversely to the major dimension. The major dimension is larger than the minor dimension. The body engages the first and second sectors at opposite ends along the major dimension in this example. In one example embodiment the body has a lozenge shape. In another example embodiment the body has a bar shape. In a further example the base comprises an annular cap. The base surface comprises a flange extending from the annular cap. The first end of the guide rod comprises a barb and the barb is received within the annular cap.

Further by way of example, a recoil spring assembly for a firearm having a slide movably mounted on a frame comprises a guide rod having a first end engageable with the frame and a second end oppositely disposed from the first end. A coil spring surrounds the guide rod and extends lengthwise therealong. The coil spring has first and second ends oppositely disposed. A body is mounted proximate the second end of the guide rod. The body has a body surface extending transversely to the guide rod and engaging at least a first sector of the second end of the coil spring. A remaining sector of the second end of the coil spring is engageable with the slide. Further by way of example, a base is mounted proximate the first end of the guide rod. The base has a base surface extending transversely to the guide rod and engaging the first end of the coil spring. In a particular example the base comprises an annular cap. The base surface comprises a flange extending from the annular cap, and the first end of the guide rod comprises a barb. The barb is received within the annular cap in this example.

By way of example the coil spring comprises a wire having a round cross section. In another example the coil spring comprises a wire having a non-round cross section. Further by way of example the body engages the second end of the coil spring at a second sector. In a specific example the second sector is diametrically opposite to the first sector. In an example embodiment the body has a major dimension and a minor dimension measured transversely to the major dimension. The major dimension is larger than the minor dimension. The body engages the first and second sectors at opposite ends along the major dimension in this example. In a specific example the body has a lozenge shape. In another example the body has a bar shape.

The invention further encompasses a pistol comprising a frame. A slide is movably mounted on the frame. A recoil spring assembly is mounted on the frame. In one example embodiment the assembly comprises a guide rod having a first end engaged with the frame and a second end oppositely disposed from the first end. A coil spring surrounds the guide rod and extends lengthwise therealong. The coil spring has first and second ends oppositely disposed. A body is mounted proximate the second end of the guide rod. The body has a body surface extending transversely to the guide rod and engaging at least a first sector of the second end of the coil spring. A remaining sector of the second end of the coil spring is engaged with the slide. An example pistol embodiment further comprises a base mounted proximate the first end of the guide rod. The base has a base surface extending transversely to the guide rod and engaging the first end of the coil spring. In a particular example embodiment the base comprises an annular cap, and the base surface comprises a flange extending radially from the annular cap. By way of further example the first end of the guide rod comprises a barb. The barb is received within the annular cap.

In one example embodiment the coil spring comprises a wire having a round cross section. In another example the coil spring comprises a wire having a non-round cross section. By way of example, the body engages the second end of the coil spring at a second sector. In a further example the second sector is diametrically opposite to the first sector. In a specific example the body has a major dimension and a minor dimension measured transversely to the major dimension. The major dimension is larger than the minor dimension. The body engages the first and second sectors at opposite ends along the major dimension. In a specific example embodiment the body has a lozenge shape. In another example embodiment the body has a bar shape.

DETAILED DESCRIPTION

Figure 1:
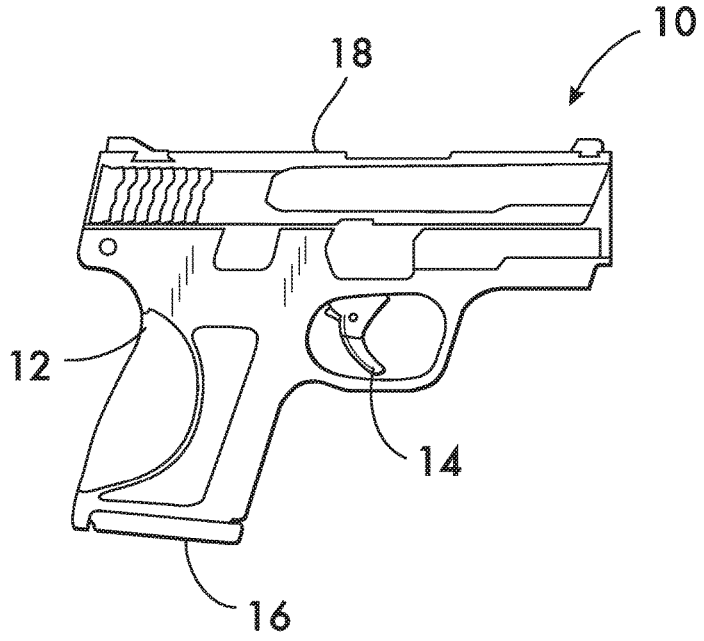
FIG. 1 is a side view of an example pistol according to the invention.

FIG. 1 shows an example pistol 10 according to the invention. Pistol 10 comprises a frame 12 which houses a trigger mechanism 14 and an ammunition magazine 16. A slide 18 is movably mounted on frame 12. Slide 18 cycles between a position known as "in battery" (shown in FIG. 5) to a position "out of battery" (FIG. 6) and back in battery during firing of the pistol 10. Pistol 10 has a captive recoil spring assembly 20 (see FIG. 2) which acts between the slide 18 and the frame 12 and makes possible the cyclic motion of the slide 18.

Figure 2:
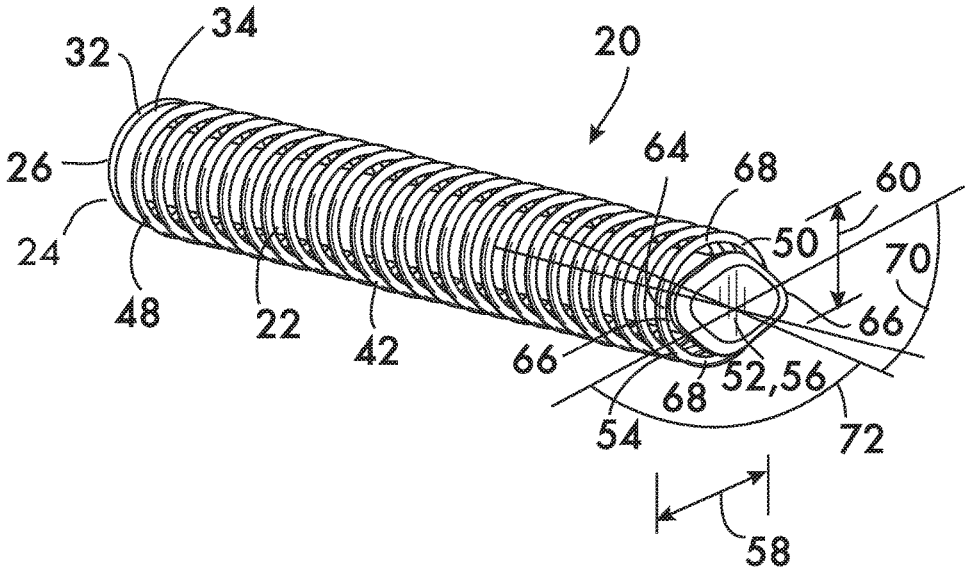
FIG. 2 is an isometric view of an example captive recoil spring assembly according to the invention.
Figure 5:
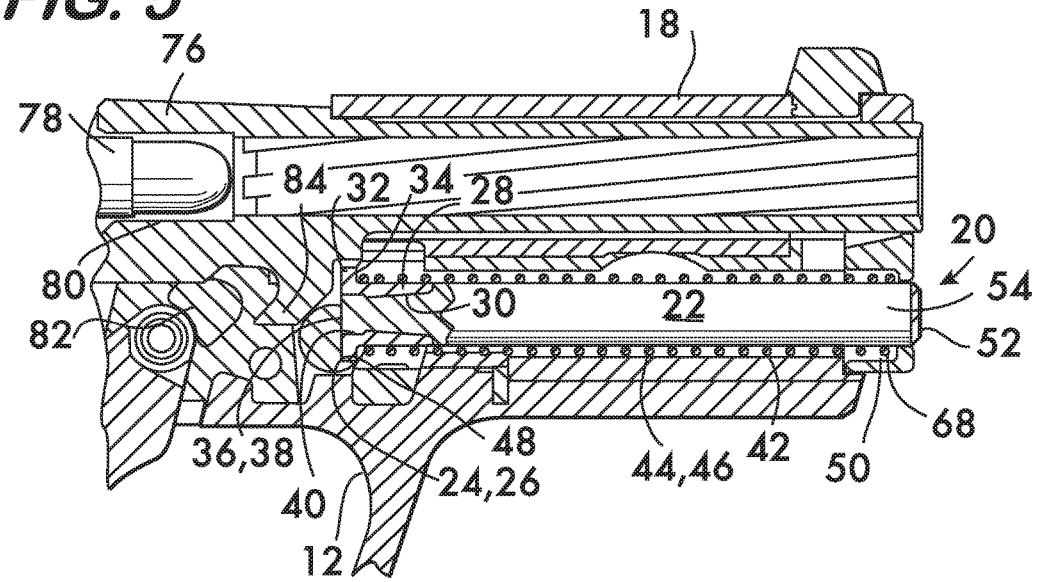
FIGS. 5 and 6 are partial longitudinal sectional views of pistol operating using an example captive recoil spring assembly according to the invention.

As shown in FIGS. 2 and 5, the example captive recoil spring assembly 20 comprises a guide rod 22. Guide rod 22 has a first end 24 which is engaged with frame 12. As shown in FIG. 5, the guide rod 22 comprises a base 26 mounted proximate to the first end 24. In this example embodiment base 26 comprises an annular cap 28 defining a bore 30 and having a flange 32 which extends radially from the cap. Flange 32 defines a base surface 34 which extends transversely to the guide rod 22. Guide rod 22 is received within bore 30 of the annular cap 28 and has a barb 36 at the first end 24. Barb 36 has a flexible enlarged head 38 in the form of a collet which engages a counter bore 40 within bore 30 to removably retain the base 26 to the guide rod 22. Other examples of first ends 24 having base surfaces are also feasible, for example, an enlarged head integrally formed at the first end 24 of the guide rod 22 may comprise base 26.

As shown in FIGS. 2 and 5 a coil spring 42 surrounds the guide rod 22 and extends lengthwise along it. In this example embodiment the coil spring 42 comprises a wire 44 having a round cross section 46. A first end 48 of spring 42 engages the base surface 34 and a second end 50 of spring 42 is engageable with a body 52 mounted proximate a second end 54 of guide rod 22 opposite to the first end 24. When assembly 20 is not installed within frame 12 of pistol 10 as shown in FIG. 2, spring 42 is thus captured between the base 26 and the body 52 and can be installed and removed in frame 12 as an assembly.

Figure 3:
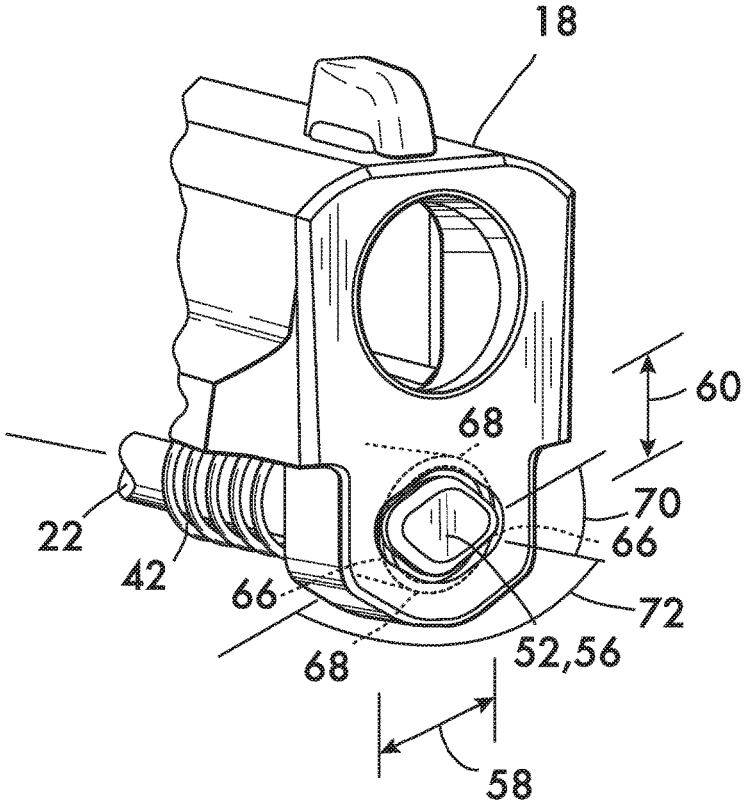
FIG. 3 is a partial isometric view of an example slide and captive recoil spring according to the invention.
Figure 4:
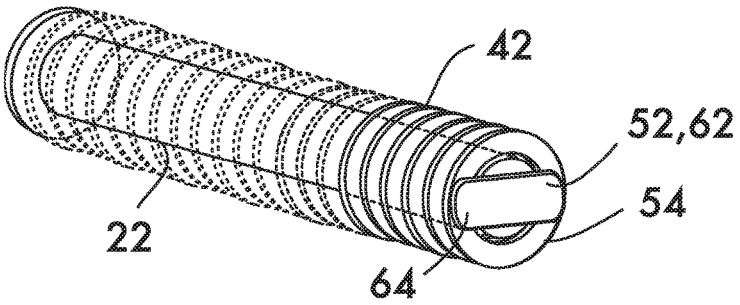
FIG. 4 is a partial isometric view of an example embodiment of a captive recoil assembly according to the invention.

As shown in FIGS. 2 and 3, the example body 52 has a lozenge shape 56 with a major dimension 58 and a minor dimension 60 measured transversely to the major dimension, the major dimension being larger than the minor dimension. Other shapes for body 52 are also feasible including, for example a bar shape 62 (see FIG. 4) forming a "Tee" at the second end 54 of the guide rod 22. Body 52 defines a body surface 64 which extends transversely to guide rod 22 and engages the second end 50 of the spring 42. As shown in FIG. 2, having different major and minor dimensions 58 and 60 allows the body 52 to engage and capture the spring 42 at one or more sectors 66, while leaving one or more remaining sectors 68 free to engage the slide 18 as shown in FIGS. 3 and 5. In the example shown in FIG. 2, body 52 engages the second end 50 of spring 42 at first and second sectors 66 diametrically opposite to one another, leaving third and fourth sectors 68, located between the first and second sectors, free to engage the slide 18 (see FIG. 3). Other engagement arrangements are of course feasible. The engagement between the body 52 and one or more sectors 66 allows a coil spring 42 having a round cross section 44 to be a captive spring without the need for tight tolerances on the dimensions of the body 52. As shown in FIG. 4, captive springs 42 may also have non-round cross sections, the spring shown having a rectangular cross section.

Regardless of the shape of body 52 or cross section of spring 42 it is advantageous for the sectors 66 engaging body 52 to be smaller than the remaining sectors 68 which engage the slide. To that end, sectors 66 may subtend angles 70 up to about 80° and remaining sectors 68 may subtend angles 72 up to about 100°.

Figure 6:
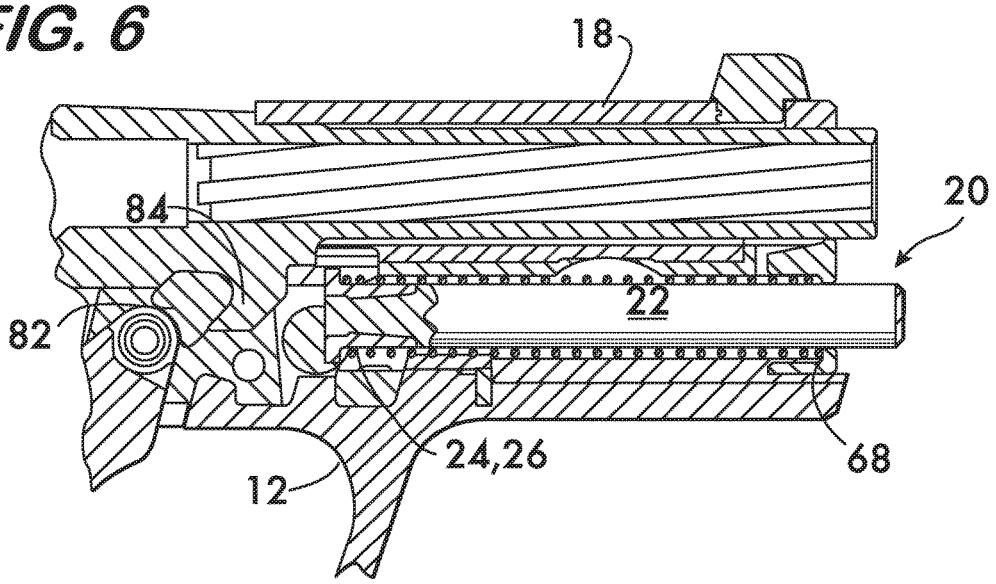

Operation of the recoil spring assembly is described with reference to FIGS. 5 and 6. As shown in FIG. 5, the slide 18 of pistol 10 is in battery, i.e., the slide fully forward on frame 12 and the breech block (not shown) engaged with the barrel 76, a cartridge 78 in the chamber 80 of the barrel. Recoil spring 42 is substantially uncompressed, with remaining sectors 68 engaging the slide 18. Upon a pull of trigger 14 (see FIG. 1) the slide 18 and barrel 80 move relative to frame 12 out of battery as shown in FIG. 6. As the barrel and slide move under the force of recoil, cam 82, affixed to frame 12, engages the cam follower 84 on the barrel 76 and halts the barrel's motion. The slide 18 continues moving along frame 12, extracting the now spent cartridge (not shown) and further compressing spring 42 against the base surface 34 of base 26, which engages the frame 12 and thus is immovable relatively to it. Once the slide 18 has moved to its fullest extent under recoil the now compressed recoil spring 42 drives the slide 18 back into battery, stripping a cartridge (not shown) from the magazine 16 (see also FIG. 1), chambering the cartridge, engaging the breech block with the barrel 80 and moving both into battery as shown in FIG. 5.

Recoil spring assemblies according to the invention allow components of a pistol to be manufactured to looser tolerances yet still use a wire recoil spring having a round cross section. The captive recoil spring provides significant advantage when field stripping the pistol for cleaning or repair, as a recoil spring, compressed during disassembly of the pistol, will not become a projectile once the spring is unconstrained, as often occurs for recoil springs that are not captive with the guide rod.

What is claimed is:

1. A recoil spring assembly for a firearm having a slide movably mounted on a frame, said assembly comprising:

a guide rod having a first end engageable with said frame and a second end oppositely disposed from said first end;

a coil spring surrounding said guide rod and extending lengthwise therealong, said coil spring having first and second ends oppositely disposed;

a base mounted proximate said first end of said guide rod, said base having a base surface extending transversely to said guide rod and engaging said first end of said coil spring;

a body mounted proximate said second end of said guide rod, said body having a body surface extending transversely to said guide rod and engaging at least a first sector of said second end of said coil spring, a remaining sector of said second end of said coil spring being engageable with said slide when said slide in in battery.

2. The assembly according to claim 1, wherein said coil spring comprises a wire having a round cross section.

3. The assembly according to claim 1, wherein said coil spring comprises a wire having a non-round cross section.

4. The assembly according to claim 1, wherein said body engages said second end of said coil spring at a second sector.

5. The assembly according to claim 4, wherein said second sector is diametrically opposite to said first sector.

6. The assembly according to claim 5, wherein said body has a major dimension and a minor dimension measured transversely to said major dimension, said major dimension being larger than said minor dimension, said body engaging said first and second sectors at opposite ends along said major dimension.

7. The assembly according to claim 6, wherein said body has a lozenge shape.

8. The assembly according to claim 6, wherein said body has a bar shape.

9. The assembly according to claim 1, wherein:

said base comprises an annular cap;

said base surface comprises a flange extending from said annular cap; and said first end of said guide rod comprises a barb, said barb being received within said annular cap.

10. A recoil spring assembly for a firearm having a slide movably mounted on a frame, said assembly comprising:

a guide rod having a first end engageable with said frame and a second end oppositely disposed from said first end;

a coil spring surrounding said guide rod and extending lengthwise therealong, said coil spring having first and second ends oppositely disposed;

a base mounted proximate said first end of said guide rod, said base having a base surface extending transversely to said guide rod and engaging said first end of said coil spring;

a body mounted proximate said second end of said guide rod, said body having a body surface extending transversely to said guide rod and engaging a first and a second sector of said second end of said coil spring, said first sector being diametrically opposite to said second sector, a third and a fourth sector of said second end of said coil spring being engageable with said slide when said slide in in battery, said third and fourth sectors being positioned between said first and second sectors.

11. The assembly according to claim 10, wherein said coil spring comprises a wire having a round cross section.

12. The assembly according to claim 10, wherein said coil spring has a non-round cross section.

13. The assembly according to claim 10, wherein said body has a major dimension and a minor dimension measured transversely to said major dimension, said major dimension being larger than said minor dimension, said body engaging said first and second sectors at opposite ends along said major dimension.

14. The assembly according to claim 13, wherein said body has a lozenge shape.

15. The assembly according to claim 13, wherein said body has a bar shape.

16. The assembly according to claim 10, wherein:

said base comprises an annular cap;

said base surface comprises a flange extending from said annular cap; and said first end of said guide rod comprises a barb, said barb being received within said annular cap.

17. A recoil spring assembly for a firearm having a slide movably mounted on a frame, said assembly comprising:

a guide rod having a first end engageable with said frame and a second end oppositely disposed from said first end;

a coil spring surrounding said guide rod and extending lengthwise therealong, said coil spring having first and second ends oppositely disposed;

a body mounted proximate said second end of said guide rod, said body having a body surface extending transversely to said guide rod and engaging at least a first sector of said second end of said coil spring, a remaining sector of said second end of said coil spring being engageable with said slide when said slide is in battery.

18. The assembly according to claim 17, further comprising a base mounted proximate said first end of said guide rod, said base having a base surface extending transversely to said guide rod and engaging said first end of said coil spring.

19. The assembly according to claim 18, wherein:

said base comprises an annular cap;

said base surface comprises a flange extending from said annular cap; and said first end of said guide rod comprises a barb, said barb being received within said annular cap.

20. The assembly according to claim 17, wherein said coil spring comprises a wire having a round cross section.

21. The assembly according to claim 17, wherein said coil spring comprises a wire having a non-round cross section.

22. The assembly according to claim 17, wherein said body engages said second end of said coil spring at a second sector.

23. The assembly according to claim 22, wherein said second sector is diametrically opposite to said first sector.

24. The assembly according to claim 23, wherein said body has a major dimension and a minor dimension measured transversely to said major dimension, said major dimension being larger than said minor dimension, said body engaging said first and second sectors at opposite ends along said major dimension.

25. The assembly according to claim 17, wherein said body has a lozenge shape.

26. The assembly according to claim 17, wherein said body has a bar shape.

27. A pistol, said pistol comprising:

a frame;

a slide movably mounted on said frame;

a recoil spring assembly mounted on said frame and comprising:

a guide rod having a first end engaged with said frame and a second end oppositely disposed from said first end;

a coil spring surrounding said guide rod and extending lengthwise therealong, said coil spring having first and second ends oppositely disposed;

a body mounted proximate said second end of said guide rod, said body having a body surface extending transversely to said guide rod and engaging at least a first sector of said second end of said coil spring, a remaining sector of said second end of said coil spring being engaged with said slide when said slide is in battery.

28. The pistol according to claim 27, further comprising a base mounted proximate said first end of said guide rod, said base having a base surface extending transversely to said guide rod and engaging said first end of said coil spring.

29. The pistol according to claim 28, wherein:

said base comprises an annular cap;

said base surface comprises a flange extending radially from said annular cap; and said first end of said guide rod comprises a barb, said barb being received within said annular cap.

30. The pistol according to claim 27, wherein said coil spring comprises a wire having a round cross section.

31. The pistol according to claim 27, wherein said coil spring comprises a wire having a non-round cross section.

32. The pistol according to claim 27, wherein said body engages said second end of said coil spring at a second sector.

33. The assembly according to claim 32, wherein said second sector is diametrically opposite to said first sector.

34. The pistol according to claim 33, wherein said body has a major dimension and a minor dimension measured transversely to said major dimension, said major dimension being larger than said minor dimension, said body engaging said first and second sectors at opposite ends along said major dimension.

35. The pistol according to claim 27, wherein said body has a lozenge shape.

36. The pistol according to claim 27, wherein said body has a bar shape.

* * * * *